United States Patent [19]

Johnson

[11] Patent Number: 4,938,292

[45] Date of Patent: Jul. 3, 1990

[54] FLUSH MOUNTED FIRE SPRINKLER HEAD

[75] Inventor: Wilfred V. Johnson, Oxford, Mass.

[73] Assignee: U.S. Fire Control Corporation, Rochdale, Mass.

[21] Appl. No.: 316,828

[22] Filed: Feb. 28, 1989

[51] Int. Cl.[5] ..... A62C 37/10

[52] U.S. Cl. ..... 169/19; 169/37; 169/57

[58] Field of Search ..... 169/22, 37, 38, 39, 169/40, 41, 90, 19, 57

[56] References Cited

U.S. PATENT DOCUMENTS

| | | | |
|---|---|---|---|
| 2,211,399 | 8/1940 | Winslow | 169/39 |
| 3,080,000 | 3/1963 | Gloeckler | 169/41 |
| 3,459,266 | 8/1969 | Ault | 169/37 |
| 3,714,989 | 2/1973 | Gloeckler | 169/39 |
| 4,117,887 | 10/1978 | Anderson | 169/37 |
| 4,465,141 | 8/1984 | Johnson | 169/37 |
| 4,830,118 | 5/1989 | Capasso | 169/37 |

*Primary Examiner*—Sherman D. Basinger
*Assistant Examiner*—Stephen P. Avila
*Attorney, Agent, or Firm*—John E. Toupal; Harold G. Jarcho

[57] ABSTRACT

A fire sprinkler head including a tubular body defining an inlet adapted for connection to a supply of pressurized fire extinguishing fluid, an outlet adapted for placement in a fire protected zone, and a cylindrical inner wall extending between the inlet and outlet and defining an annular recess; and a valve comprising a piston and a cup-shaped gasket retained by and mounted for movement within the body from a closed position to an open position and providing in the closed position a fluid tight seal between the inlet and the outlet and allowing in the open position fluid flow therebetween; the cup-shaped gasket comprising a bottom portion for receiving a force for inducing the gasket movement and produced by pressurized fluid at the inlet, an annular skirt portion having one end joined to the bottom portion and an opposite end retained by the piston, and an annular lip portion extending outwardly from the skirt portion and received by the annular recess so as to form a fluid tight seal therewith. Also included is a locking mechanism retained by the valve and movable between an engaged position and a disengaged position, the locking mechanism being shaped and arranged in the engaged position to exert on the cup-shaped gasket a locking force retaining the annular lip portion within the annular recess to thereby prevent relative movement therebetween.

20 Claims, 2 Drawing Sheets

1/2

2/2

FLUSH MOUNTED FIRE SPRINKLER HEAD

BACKGROUND OF THE INVENTION

This invention relates generally to fire extinguishing sprinkler heads and, more particularly, to an automatically extendable sprinkler head that can be mounted substantially flush with the ceiling of a fire protected enclosure.

Sprinkler systems are used extensively to provide automatic fire protection for residential, commercial and public buildings. A major sprinkler heads they employ. The sprinkler heads generally include rather unattractive, temperature responsive structures that extend a substantial distance below the ceilings of enclosures in which they are installed. In addition to presenting a generally unaesthetic appearance, projecting sprinkler heads create shadows that are undesirable in many types of structures.

In the interest of improving the appearance of sprinkler systems, various types of so-called recessed sprinkler heads have been disclosed. Such heads generally include a valve and deflector assembly that is movably mounted within a housing adapted for flush mounting in a ceiling. In response to elevated temperature, a fusible retaining element melts to release the valve and deflector assembly which is moved by water pressure into operational position below the recessed housing. In one type of flush mounted sprinkler head, the recessed valve and deflector assembly is retained in position only by a fusible alloy. Examples of such a sprinkler head are disclosed in U.S. Pats. Nos. 3,067,823 and 3,198,258. Because the full force produced by the system's water pressure is restrained by the fusible alloy, sprinkler heads of this type do not Provide the quick response and reliability that is required for a fire protection system. Other prior recessed sprinkler heads employ various types of lever arrangements to reduce the force that is restrained by the fusible alloy. Heads of that type are disclosed in U.S. Pats. Nos. 2,211,399; 3,459,266; and 3,714,989. Although improving response and reliability, the lever assemblies are bulky, unattractive and costly. U.S. Pat. No. 3.080,000 discloses another recessed sprinkler head utilizing a modified assembly for reducing the force restrained by the fusible alloy. The sprinkler head disclosed in that patent employs bowed struts that are connected mechanically in parallel with the fusible alloy. As with the above-described lever assemblies, the bowed strut assembly is bulky and unattractive and adds substantially to the manufacturing costs of the sprinkler head. Another recessed sprinkler head is disclosed in U.S. Pat. No. 4,465,141. Although, the head therein disclosed offers improved performance, the need exists for reliable sprinkler heads of reduced cost.

The object of this invention, therefore, is to provide a reduced cost fire sprinkler head that can be mounted substantially flush with the ceiling of a protected enclosure and which will quickly, automatically and reliably move into operational position below the ceiling in response to a predetermined rise in ambient temperature.

SUMMARY OF THE INVENTION

The invention is a fire sprinkler head including a tubular body defining an inlet adapted for connection to a supply of pressurized fire extinguishing fluid, an outlet adapted for placement in a fire protected zone, and a cylindrical inner wall extending between the inlet and outlet and defining an annular recess; and a valve comprising a piston and a cup-shaped gasket retained by and mounted for movement within the body from a closed position to an open position and providing in the closed position a fluid tight seal between the inlet and the outlet and allowing in the open position fluid flow therebetween; the cup-shaped gasket comprising a bottom portion for receiving a force for inducing the gasket movement and produced by pressurized fluid at the inlet, an annular skirt portion having one end joined to the bottom portion and an opposite end retained by the piston, and an annular lip portion extending outwardly from the skirt portion and received by the annular recess so as to form a fluid tight seal therewith. Also included is a locking mechanism retained by the valve and movable between an engaged position and a disengaged position, the locking mechanism being shaped and arranged in the engaged position to exert on the cup-shaped gasket a locking force retaining the annular lip portion within the annular recess to thereby prevent relative movement therebetween, and shaped and arranged in said disengaged position to substantially eliminate the force between the annular lip portion and the annular recess and to allow relative movement therebetween; and a latching mechanism automatically movable from a latched position to a released position in response to a predetermined condition, the latching mechanism being shaped and arranged in the latched position to retain the locking mechanism in the engaged position and shaped and arranged in the released position to permit movement thereof into the disengaged position. The cup-shaped gasket simplifies construction and reduces cost of the head.

According to one feature, the head includes a deflector supported for movement with the piston and adapted to deflect fluid discharged from the outlet with the gasket in the open position, and the locking mechanism is disposed between the inlet and the deflector. The deflector provides a desirable discharge pattern for extinguishing fires.

According to another feature of the invention, the latching mechanism comprises a fusible member and the predetermined condition is the melting temperature thereof. The fusible member provides reliable activation of the sprinkler head at a predetermined temperature.

According to other features of the invention, the cup-shaped gasket includes an inner wall portion tapered outwardly and away from its bottom portion and defining a cavity encircled by its annular lip, and the locking mechanism comprises a locking body with a tapered outer surface conforming to and engaging the inner wall portion so as to produce the locking force. This arrangement efficiently produces the desired locking force.

According to yet other features of the invention, the gasket includes a transverse flange portion extending outwardly from its opposite end, and the piston comprises an annular clamp retaining the flange portion. This arrangement provides retention of the gasket in an efficient manner.

According to still further features of the invention, the clamp comprises an annular plate disposed adjacent to and surrounding the outlet and defining a first annular clamping surface, and a clamp body threadedly engaging the plate and defining a second annular clamping surface separated from the first annular clamping surface by an annular space retaining the flange portion.

This arrangement simplifies assembly of the sprinkler head.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
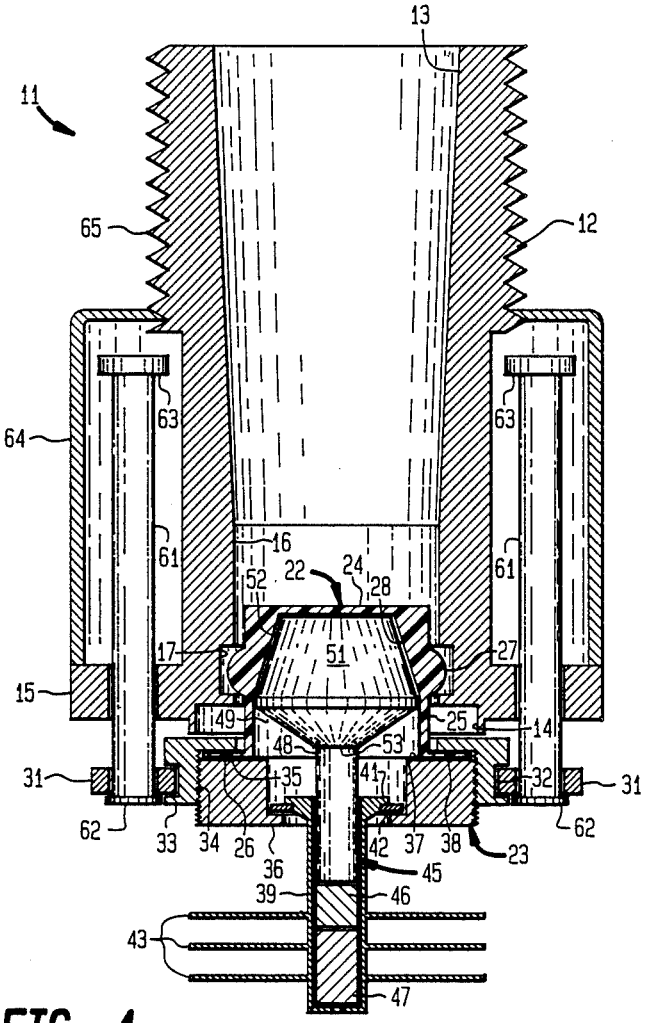
FIG. 1 is a schematic cross-sectional view of a fire sprinkler head assembly according to the invention.
Figure 2:
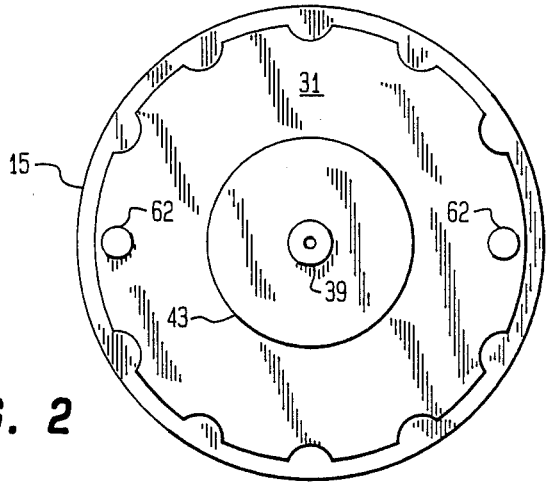
FIG. 2 is a bottom view of the sprinkler head shown in FIG. 1.
Figure 3:
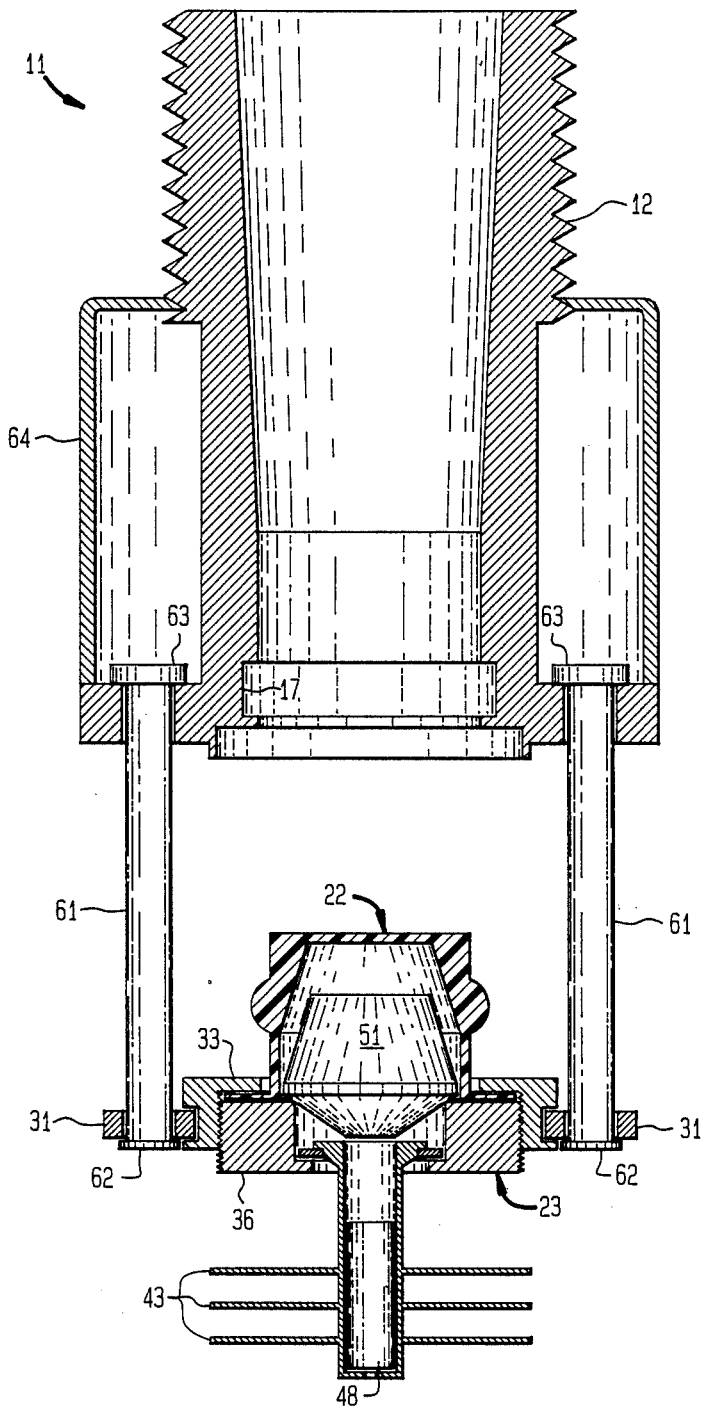
FIG. 3 is a schematic cross-sectional view showing the head of FIG. 1 in an activated position.

Illustrated in FIGS. 1–3 is a fire sprinkler head 11 including a tubular body 12 that defines an inlet 13 and an outlet 14. Formed externally on the outlet end of the tubular body 12 is an annular shoulder 15 while an internal counterbore establishes an inner annular shoulder 16. Also formed in the inner wall 16 of the tubular body 12 between the inlet 13 and the outlet 14 is an annular recess 17.

Retained by the body 12 is a valve mechanism 21 including a cup-shaped gasket 22 and a piston assembly 23. The gasket 22 has a bottom portion 24 that receives a force produced by fluid pressure at the inlet 13 and a skirt portion 25 having one end joined to the bottom portion 24 and an opposite end terminating with an outwardly extending transverse flange 26. Projecting outwardly from the skirt portion 25 is an annular lip portion 27 that is received by the annular recess 17 so as to form a fluid tight seal therewith. An inner wall portion 28 of the gasket 22 tapers outwardly and away from the bottom portion 24.

The piston assembly 23 includes a split annular deflector plate 31 with a scalloped outer periphery and retained in a groove 32 of an annular clamp plate 33. A threaded counterbore 34 in the clamp plate 33 defines a first annular clamping surface 35. Engaging the threaded bore 34 is a clamp body 36 that defines a second clamping surface 37 spaced from the first clamp surface by an annular space 38 that retains the flange Portion 26 of the gasket 22. A cylindrical receptacle 39 extends through a central opening in the clamp body 36 and has a flanged open end 41 retained in a counterbore therein by a snap ring 42. Projecting from the receptacle 39 are a plurality of heat transfer fins 43.

The receptacle 39 retains a latching mechanism 45 including a pair of fusible pellets 46 and 47 and a retainer pin 48. Retained in a cavity 49 within the gasket 22 is a locking body 51. A tapered outer surface 52 of the locking body 51 engages and conforms to the tapered inner wall portion 28 of the gasket while a bottom surface 53 of the locking body engages the retainer pin 48.

Limiting movement of the piston 23 with respect to the body 12 are a plurality of rods 61. First ends of the rods 61 extend through openings in the deflector plate 31 and are retained by first terminal flanges 62. Opposite ends of the rods 61 extend through openings in the body flange 15 and are retained by second terminal flanges 63. Enclosing the rods 61 is a cylindrical housing 64 that engages a threaded outer wall 65 of the body 12.

During assembly of the sprinkler head 11, the cup-shaped gasket 22 is positioned within the tubular body 12 in a closed position as shown in FIG. 1 with the annular lip 27 providing with the annular recess 17 a fluid tight seal between the inlet 13 and the outlet 14. The locking body 51 is then positioned in the cavity 49, the clamp body 36 is positioned in the clamp plate 33 and rotated into the threaded bore 34 until a desired force is established through the retainer pin 53 between the locking body 51 and the fusible elements 46, 47. With the latching assembly 45 thereby in the latched position shown in FIG. 1, the locking body 51 is held in a position forcing the annular lip 27 into the annular recess and preventing relative movement therebetween.

After assembly, the individual sprinkler heads 11 are installed in sprinkler systems to provide fire protection for a protected enclosure. Each tubular housing 12 is inserted through a fitted opening in a ceiling (not shown) into a recessed position shown in FIG. 1. With the shoulder 15 of the housing 12 engaging the ceiling, only the deflector plate 31 and the lower portion of the piston assembly 23 are exposed to establish a substantially flush mounting. After such installation, the inlet 13 is connected for fluid communication with a supply of pressurized fire extinguishing fluid such as a water main.

With fluid pressure at the inlet 13, a primary force is applied on the bottom portion 24 of the gasket 22 axially to the inner wall 16 of the tubular body 12. That force is retained by the locking body 51 which maintains the annular lip 27 of the gasket 22 fluid tightly sealed in the annular recess 17 to prevent fluid flow between the inlet 13 and the outlet 14.

However, upon the occurrence of conditions that establish an excessive ambient temperature within a protected zone occupied by a unit 11, the fusible pellets 46, 47 melt and remove holding force from the retainer pin 48. This causes release of the latching assembly 45 wherein the retainer pin 48 moves axially downwardly into the released position shown in FIG. 3. Movement of the retainer pin 48 into its released position allows the locking body 51 to move downwardly and the tapered surface 52 thereon to move transversely with respect to the tapered inner wall portion 28 of the gasket 22. Accordingly, fluid pressure on the bottom portion 24 moves the gasket into open position shown in FIG. 3 with the annular lip 27 disengaged from the annular recess 17.

The extent to which the piston 23 moves below the tubular body 12 and the attached ceiling is determined by the rods 61. As the piston 23 moves downwardly, the flanged head portions 63 of the rods 61 engage the flange 15 thereby preventing further movement as shown in FIG. 3. With the valve in the open, operative position shown, extinguishing fluid flows between the inlet 13 and the outlet 14 and is deflected by the deflector 31 into the fire protected zone. After extinguishment of the fire, the head 11 is easily returned to its inactive, recessed position by simply removing the clamp body 36, replacing the fusible alloy pellets 46, 47, and returning the piston 23 and latching mechanism into the portions shown in FIG. 1.

Obviously, many modifications and variations of the present invention are possible in light of the above teachings. It is to be understood, therefore, that the invention can be practiced otherwise than as specifically described.

What is claimed is:

1. Fire sprinkler apparatus comprising:

a tubular body means defining an inlet adapted for connection to a supply of pressurized fire extinguishing fluid, an outlet adapted for placement in a fire protected zone, and a cylindrical inner wall extending between said inlet and said outlet and defining an annular recess;

a valve means comprising a piston means and a cup-shaped gasket retained by and mounted for movement within said body means from a closed position to an open position and providing in said closed position a fluid tight seal between said inlet and said outlet and allowing in said open position fluid flow therebetween; said cup-shaped gasket comprising a bottom portion for receiving a force for inducing said movement and produced by pressurized fluid at said inlet, an annular skirt portion having one end joined to said bottom portion and an opposite end retained by said piston means, and an annular lip portion extending outwardly from said skirt portion and received by said annular recess so as to form a fluid tight seal therewith;

locking means retained by said valve means and movable between an engaged position and a disengaged position, said locking means being shaped and arranged in said engaged position to exert on said cup-shaped gasket a locking force retaining said annular lip portion within said annular recess to thereby prevent relative movement therebetween, and shaped and arranged in said disengaged position to substantially eliminate said force between said annular lip portion and said annular recess and to allow relative movement therebetween; and latching means automatically movable from a latched position to a released position in response to a predetermined condition, said latching means being shaped and arranged in said latched position to retain said locking means in said engaged position and shaped and arranged in said released position to permit movement of said locking means into said disengaged position.

2. An apparatus according to claim 1 including deflector means supported for movement with said piston means and adapted to deflect fluid discharged from said outlet with said gasket in said open position, and wherein said locking means is disposed between said inlet and said deflector means.

3. An apparatus according to claim 2 wherein said deflector means comprises an outer periphery that is outwardly displaced from said locking means in directions transverse to the direction of movement of said valve means.

4. An apparatus according to claim 1 wherein said latching means comprises a fusible means and said predetermined condition is the melting temperature of said fusible means.

5. An apparatus according to claim 4 wherein said latching means further comprises a retainer means held by said fusible means in contact with said locking means so as to prevent movement thereof into said disengaged position and released to allow said movement by melting of said fusible means.

6. An apparatus according to claim 1 wherein said movement of said locking means between said engaged and disengaged positions comprises movement in a direction transverse to an axis of said cylindrical inner wall.

7. An apparatus according to claim 6 wherein said latching means comprises a fusible means and said predetermined condition is the melting temperature of said fusible means.

8. An apparatus according to claim 7 wherein said latching means further comprises a retainer means held by said fusible means in contact with said locking means so as to prevent movement thereof into said disengaged position and released to allow said movement by melting of said fusible means.

9. An apparatus according to claim 8 wherein said retainer means comprises a retainer pin engaged between said locking means and said fusible means and adapted to move in the direction of said axis in response to melting of said fusible means.

10. An apparatus according to claim 1 wherein said cup-shaped gasket includes an inner wall portion tapered outwardly and away from said bottom portion and defining a cavity encircled by said annular lip, and said locking means comprises a locking body with a tapered outer surface conforming to and engaging said inner wall portion so as to produce said locking force.

11. An apparatus according to claim 10 wherein said gasket includes a transverse flange portion extending outwardly from said opposite end, and said piston means comprises an annular clamp means retaining said flange portion.

12. An apparatus according to claim 11 wherein said latching means comprises a fusible means and said predetermined condition is the melting temperature of said fusible means.

13. An apparatus according to claim 12 wherein said piston means comprises a receptacle retaining said fusible means in a position that induces on said locking body a latching force that produces said locking force.

14. An apparatus according to claim 13 wherein said piston means comprises adjustment means for adjusting the latching force applied by said fusible means to said locking body.

15. An apparatus according to claim 14 wherein said clamp means comprises an annular plate disposed adjacent to and surrounding said outlet and defining a first annular clamping surface, and a clamp body defining a second annular clamping surface separated from said first annular clamping surface by an annular space; and said flange portion is retained within said annular space.

16. An apparatus according to claim 15 wherein said adjustment means comprises a threaded engagement between said annular plate and said clamp body that permits adjustment in the length of said annular space.

17. An apparatus according to claim 16 wherein an outer surface of said annular plate defines a deflector means for deflecting fluid discharged from said outlet.

18. An apparatus according to claim 17 wherein said piston means further comprises rod means coupled between said tubular body and said annular plate and adapted to limit relative movement therebetween.

19. An apparatus according to claim 18 wherein said clamp body defines said receptacle.

20. An apparatus according to claim 19 wherein said clamp body comprises fin means for improving heat transfer between the environment and said fusible means retained in said receptacle.

* * * * *